US005304892A

United States Patent [19]

Lewandowski et al.

[11] Patent Number: 5,304,892

[45] Date of Patent: Apr. 19, 1994

[54] DOUBLE-ENDED HIGH-PRESSURE DISCHARGE LAMP

[75] Inventors: Bernd Lewandowski, Feldafing; Dieter Franke, Munich; Walter Kiele, Munich; Juergen Begemann, Munich; Joern Dierks, Penzing, all of Fed. Rep. of Germany

[73] Assignee: Patent-Treuhand-Gesellschaft für elektrische Glühlampen mbH, Munich, Fed. Rep. of Germany

[21] Appl. No.: 766,001

[22] Filed: Sep. 26, 1991

[30] Foreign Application Priority Data

Oct. 2, 1990 [DE] Fed. Rep. of Germany ..... 4031117

[51] Int. Cl.[5] ..... H01J 61/36

[52] U.S. Cl. ..... 313/623

[58] Field of Search ..... 313/623, 332, 335

[56] References Cited

U.S. PATENT DOCUMENTS

| | | | |
|---|---|---|---|
| 3,315,116 | 4/1967 | Beese | 313/623 |
| 3,675,068 | 7/1972 | Strauss | 313/623 |
| 4,647,814 | 3/1987 | Dobrusskin et al. . | |
| 4,959,587 | 9/1990 | Schug | 313/623 |

FOREIGN PATENT DOCUMENTS

| | | | |
|---|---|---|---|
| 1489616 | 4/1969 | Fed. Rep. of Germany . | |
| 1589262 | 7/1970 | Fed. Rep. of Germany . | |
| 94355 | 5/1984 | Japan | 313/623 |
| 241850 | 10/1988 | Japan | 313/623 |
| 682376 | 11/1952 | United Kingdom . | |
| 1230955 | 5/1971 | United Kingdom . | |
| 1231141 | 5/1971 | United Kingdom . | |

OTHER PUBLICATIONS

Soviet Inventions Illustrated, El Sektion, Woche E 12, 5, May 1982, Derwent Publications Ltd., London, UK.

*Primary Examiner*—Sandra L. O'Shea

*Attorney, Agent, or Firm*—Frishauf, Holtz, Goodman & Woodward

[57] ABSTRACT

To permit high lamp currents to be applied to lamp electrodes (5, 6) of a discharge vessel (2) from which two elongated necks (3, 4) extend via current supply leads (23, 35), the discharge vessel is first made as a generally rotation-symmetrical element, to which tubular cylindrical neck tubes (17) are sealed. A cylindrical plug element (26, 40) is placed in the neck tube adjacent the discharge vessel. A subassembly is then made of a core element, which can be constructed as a single or a composite structure of quartz glass, for example by telescopically fitting quartz glass tubes over a central core, and melt-sealing the tubes and core together. Molybdenum disks (7, 8; 22) are placed against the end faces of the core element, and a plurality, for example four, molybdenum connecting foils (11–16, 27) are secured to the circumferences of the disks, to axially connect them together. The subassembly is then introduced into the neck tube through the plug element, a further quartz glass tube is placed over the current supply lead (23) and formed with a bulbous enlargement, which is sealed to the interior of the neck portion. The basic lamp structure is now complete. neck portion, with the core element and foil-connected disks therein is then flushed. After flushing, the disks, foils, and core element are all melt-sealed together within the neck tube and the bulbous portion of the quartz tube, together with the remaining portion of the neck tube, is severed.

8 Claims, 6 Drawing Sheets

DOUBLE-ENDED HIGH-PRESSURE DISCHARGE LAMP

Reference to related patent and application the disclosures of which are hereby incorporated by reference, assigned to the assignee of the present application:

U.S. Pat. No. 4,647,814, Dobrusskin et al.

U.S. Ser. No. 07/766,005, filed Sep. 26, 1991, Lewandowski et al.

U.S. Ser. No. 07/766,451, filed Sep. 26, 1991, Dixon et al., now U.S. Pat. No. 5,200,669.

FIELD OF THE INVENTION

The present invention relates to high-pressure discharge lamps, and more particularly to high-pressure discharge lamps of high power, having lamp currents which may exceed 100 A, for example of 130 A and even more, and to a method to make the lamp. The lamp construction and method may, of course, also be used with lamps of lower power requirements

BACKGROUND

The high-pressure discharge lamps to which the present invention relates, and which are , for instance, shown in the referenced U.S. Pat. No. 4,647,814, Dobrusskin et al., assigned to the assignee of the present application, are particularly suitable for illumination of theater stages, television and motion picture film studios and the like. The light flux should be high and, further, have a color temperature which is similar to daylight, with a very good color rendition index. Such high-pressure discharge lamps have a discharge vessel, retaining a fill which includes metal halides. Prior art lamps of this type provide a light flux of over one million lumens; in a typical lamp, and with an operating current of 65 A and an arc power of 12 kW, a light flux of 1.1. mega lumens can be obtained. The electrodes within the discharge vessel are rod or pin-like and retained in the discharge vessel by being melt-sealed therein, with a molybdenum sealing foil providing a current supply connection for the electrodes.

The requirements for still higher light output and higher power lamps have led to investigations of loading of the current supply connection. To obtain still higher light flux, standard melt seals permit operating currents of at the most 100 A. Higher operating currents lead to excessive heating of the melt, and the molybdenum sealing foils tend to corrode, and separate from the seal. The metal halide fill in the lamp also causes devitrification of the discharge vessel, so that the average lifetime of the lamp is short and becomes economically unsatisfactory.

Other high-pressure discharge lamps of this type having a fill of mercury and a rare gas or of extra-high pressure rare gas are used specifically in the manufacture of electronic components.

THE INVENTION

It is an object to provide a high-pressure discharge lamp which has electrode melt seals which can tolerate operating currents far in excess of 20 A. These seals, further, should be simple in construction and permit ready manufacture.

Briefly, a sealing and connection arrangement is provided between the electrodes within the discharge vessel and an external current supply, which includes two metal disks. One of the metal disks is electrically and mechanically secured to the end region of the electrode and the other metal disk is electrically and mechanically secured to the end region of the current supply lead. At least two, and preferably four elongated sealing foils extend between the first and second disks, secured to the disks, for example, at a circumferential region or at the rims thereof. The melt seal then includes a quartz glass filling within the connection necks of the lamps, which embed the at least two, and preferably four sealing foils connecting the first and second disks. The quartz glass filling, and the necks of the lamps, are melt-sealed together, so that the quartz glass filling forms with the neck portions of the discharge vessel, a solid quartz glass cylinder, in which the sealing foils as well as the two disks are melt-sealed. A plug element, through the electrode shaft passes, is melt-sealed in the neck adjacent the discharge vessel to center the electrode and provide for thermal isolation.

To make such a lamp, in accordance with a feature of the invention, the discharge vessel is formed as an essentially rotation-symmetrical body which has an opening located at opposite axial ends. A hollow or tubular cylindrical neck tube is then melt-sealed to the quartz glass to close off the opening of the discharge vessel at each one of the opposite axial ends; the initially hollow tubular neck tube will extend from aligned opposite ends of the essentially rotation-symmetrical discharge vessel. An electrode-sealing body subassembly is then inserted into the hollow neck tube, extending from the discharge vessel.

The metal disks, which can be formed with a central opening and slipped over the end portion of the electrode shaft, and of the current supply lead, respectively, and then welded or brazed,. respectively, to the electrode shaft and the current supply lead, provide for high stability of the neck portions of the lamp. The lamp current can distribute itself over the at least two, and preferably four elongated sealing foils in each one of the necks of the discharge vessel, so that the current loading for any one individual sealing foil is substantially less than that for a single foil. In accordance with a preferred feature of the invention, the sealing foils are uniformly located, spaced from each other, and distributed about the circumference of the metal disks, and extend parallel to the longitudinal axis of each one of the vessel necks. This provides for essentially uniform heating of the neck when the lamp is operated, and prevents local overloading in the melt and provides for a uniform temperature rise throughout the entire neck portion, eliminating temperature differences between respective portions of the neck.

In addition, the ends of the electrode shafts and of the current supply leads as well as the metal disks which are melt-sealed into the bulb necks may be provided, either partly or completely, with a refractory metal foil having a surface profile. The foil consists preferably of one of the metals selected from the group of molybdenum, tantalum or tungsten or from an alloy of the said metals and preferably has a base thickness of between 0.02 MM and 0.2 mm, depending on the wattage of the lamp. By wrapping the profiled foil about the ends of the electrode shafts, current supply leads and metal disks, adhesion of the quartz glass to the metal parts and tension therebetween is avoided. Mechanical tensions and cracks in the quartz glass which might arise when the seal cools off can thus be avoided.

Upon embossing or profiling, the thickness of the foil changes by a factor of between 1.2 to 5.

The profiled foil, which can be embossed with ridges and, on the reverse side, complementary grooves, acts as a resilient buffer to alleviate stresses arising due to differential dimensional changes between glass and metal components, upon change in temperature.

The profiled foils also provide for satisfactory axial alignment of the electrodes and current supply leads. Due to the foils, the quartz glass cylinders of the bulb necks which are still loose prior to the melt-sealing are fixed in position so that additional measures for clamping the quartz glass cylinders in position may be omitted.

The lamp construction permits operating currents well over 100 amperes, for example up to 130 A, and even more, without resulting in damage to the melt seals, or decreasing the average lifetime of the lamp over lower powered lamps. These high currents, and power ratings of up to 24 kW, permit the construction of high-pressure discharge lamps having a metal halide fill and providing light flux of over 2 million lumens, that is, over 2 Mlm.

In accordance with a preferred feature of the invention, the lamps are made by first generating an essentially rotation-symmetrical discharge vessel to which, axially aligned, a hollow cylindrical neck tube of quartz glass is melted-on. Subsequently, a filling body is formed which has essentially the general shape of the interior space within the neck in the region between the metal disks. This filling body can be obtained by suitably cutting and following out a solid cylinder of quartz glass, or by melting together a plurality of hollow cylinders with a solid core, all of quartz glass, each having circular cross section. This filling body is seated with one end on the metal disk connected to the electrode, and on the other metal disk, connected to the externally extending current supply lead. The ends of the sealing foils are then connected to the metal disks by welding them to the rims of the metal disks. The resulting subassembly is then pushed into each one of the hollow cylindrical neck tubes. A short hollow cylindrical tube of quartz glass is placed over the externally extending current supply lead. This short glass tube is expanded in barrel or olive shape, to fit into the interior diameter of the neck tube.

The expanded end of the short tube is then melt-sealed with its outer edge against the inner wall of the hollow cylindrical outer tube, to provide a tight seal. This permits flushing of the discharge space as well as of the neck portion with the sealing foil subassembly between the hollow cylindrical neck tube and the filling body through a sealing nipple formed on the discharge vessel, for example with argon or the like, and, after repeated flushing, as required, to evacuate the discharge space of the discharge vessel. After flushing and evacuating, the sealing foils with the fill body are melt-sealed to the hollow cylindrical neck tube, at a vacuum pressure of 20 mbar argon. After this melt-sealing step, the far end of the neck tubes at the level of the free ends of the current supply lead and above the olive-shaped enlargement is severed, and removed from the neck tube. This leaves the externally extending current supply lead projecting from the respective neck tube. Then, bases can be fitted on the respective neck tubes at the free ends thereof, and electrically connected to the externally extending current supply leads in accordance with any standard and well known procedure.

DRAWINGS

Figure 2:
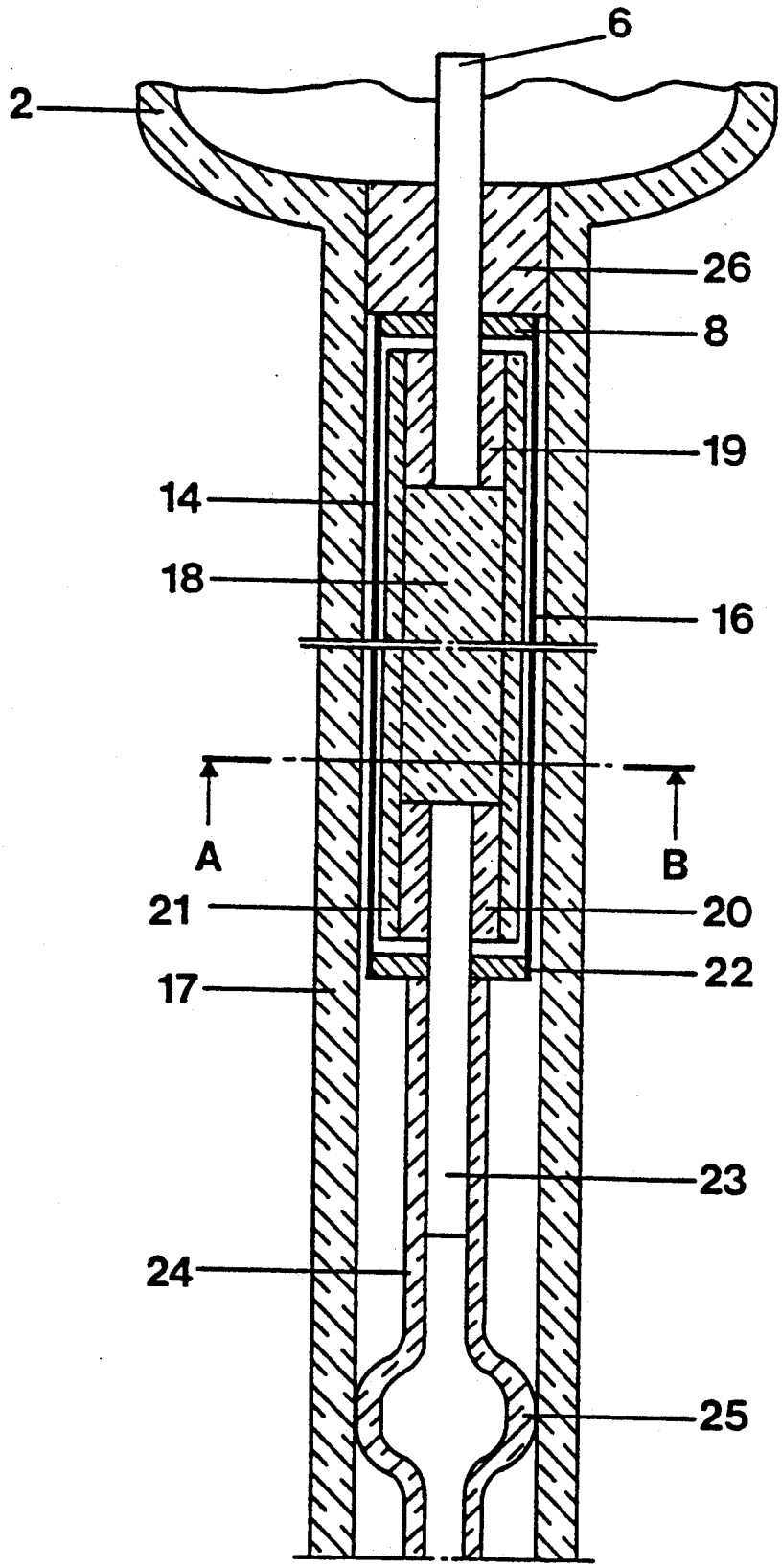
FIG. 2 is a longitudinal section through a lamp neck before the sealing foils are melt-sealed to the neck.
Figure 2A:
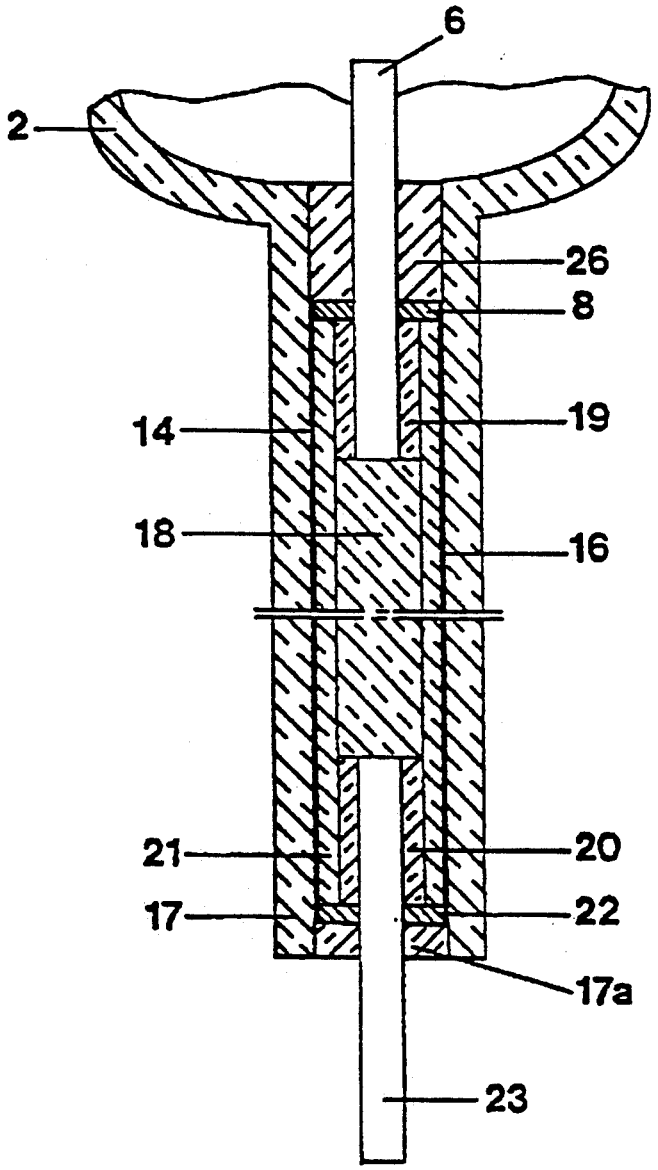
Figure 3:
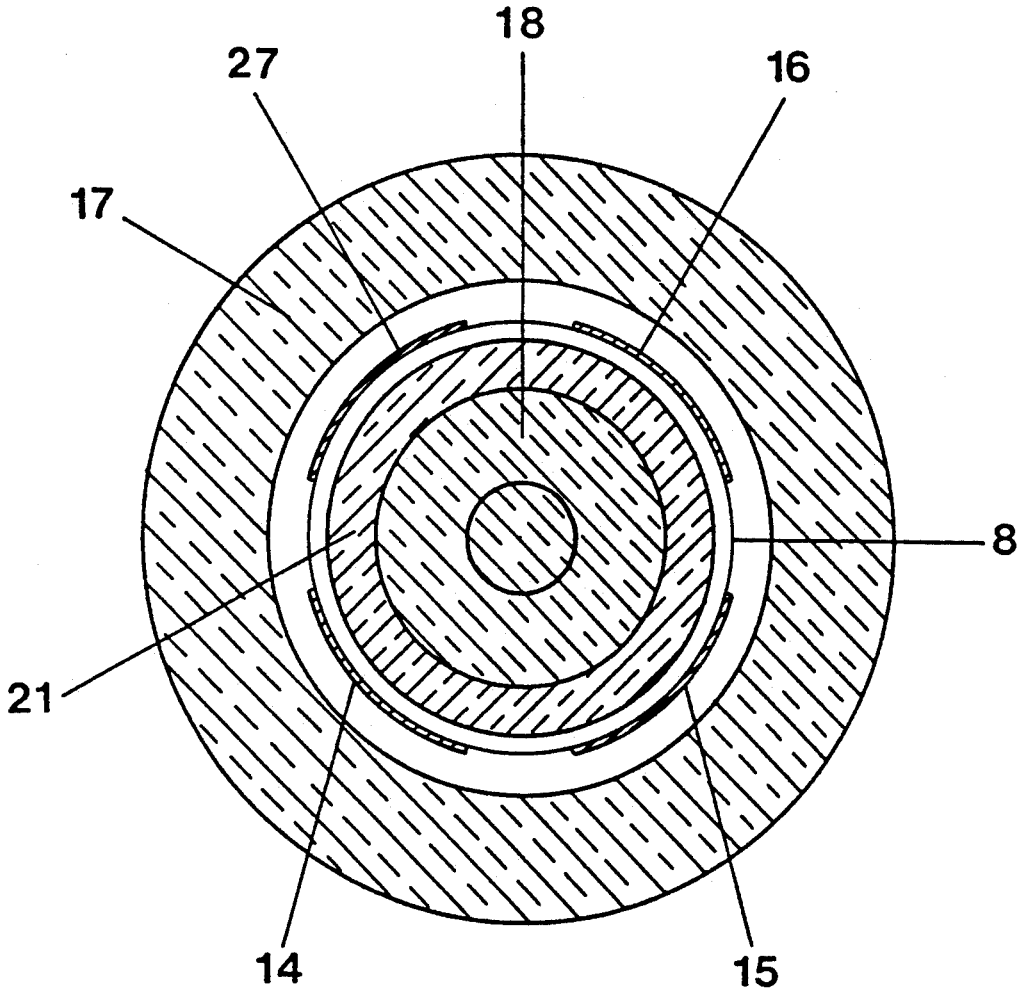

FIG. 2*a* illustrates the lamp neck after sealing;

FIG. 3 is a cross-section taken along line A-B of FIG. 2 and before the foils are sealed to the lamp neck, with exaggerated spacing between elements for ease of visualization.

Figure 4:
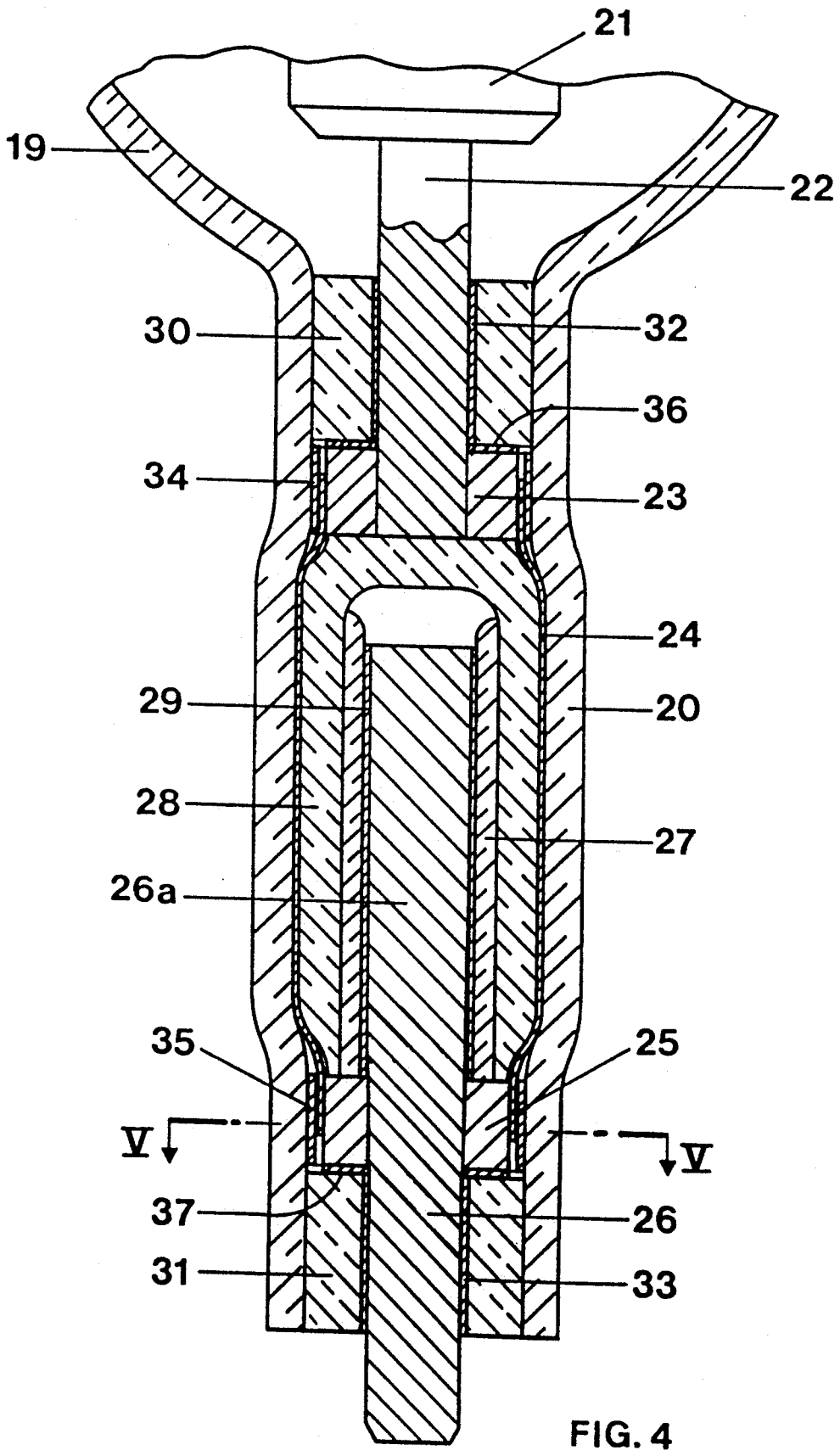
Figure 5:
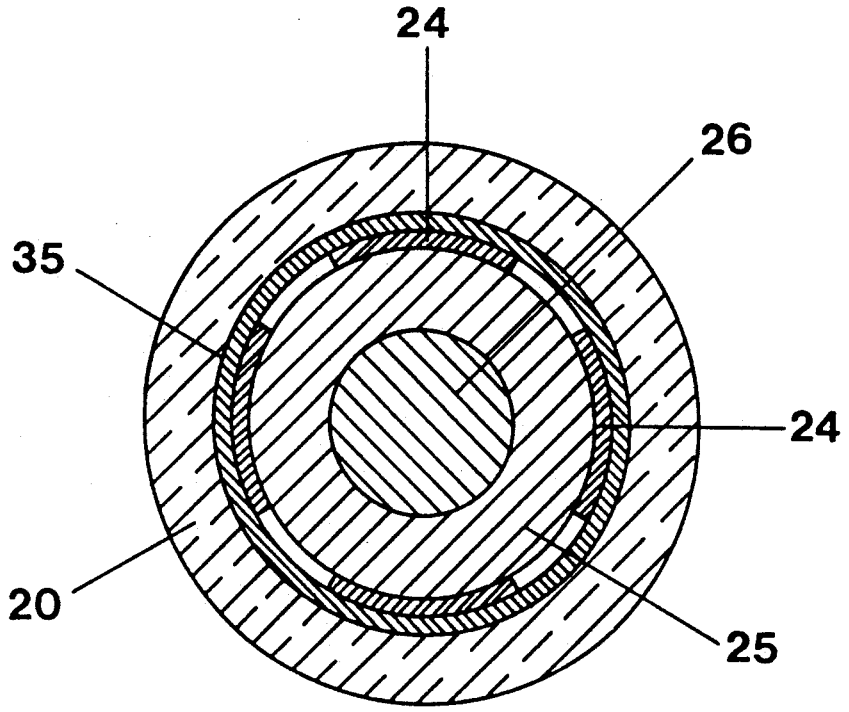
Figure 6:
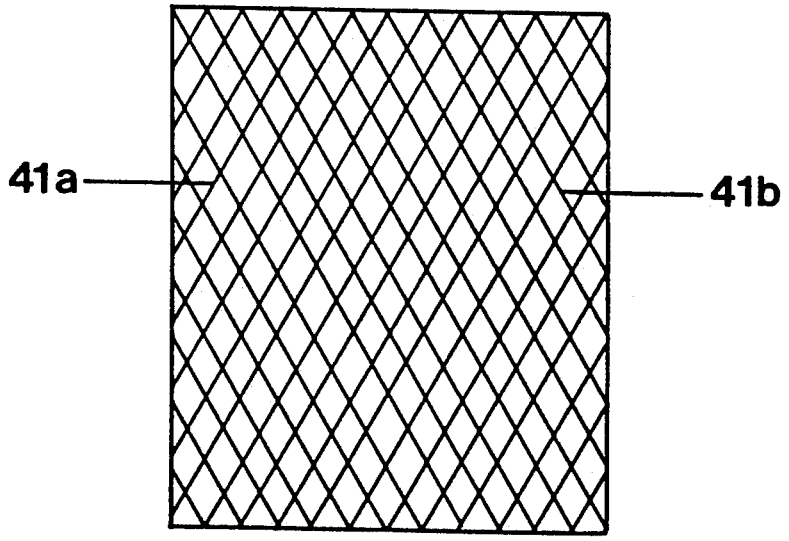
Figure 4:
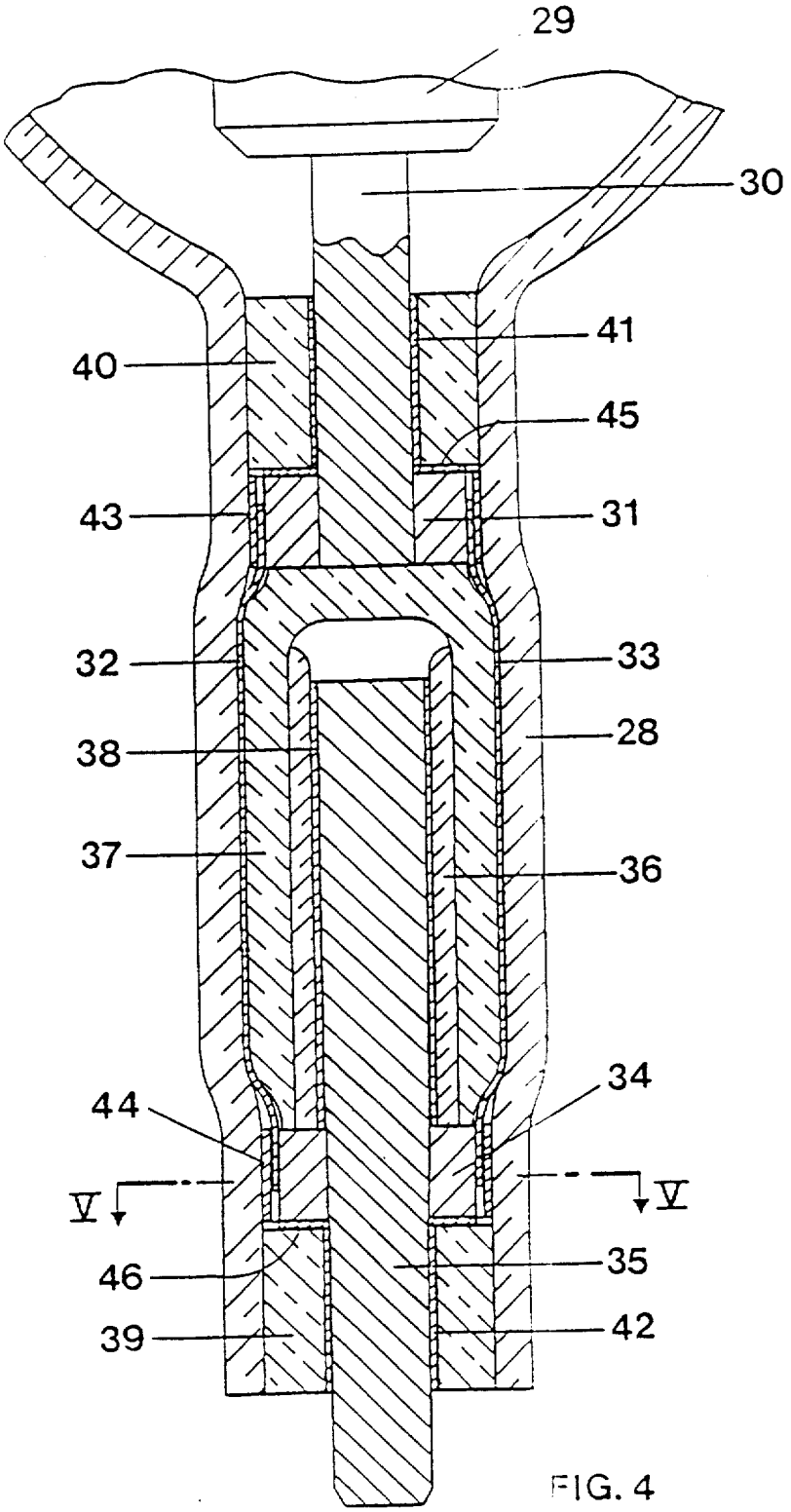
Figure 5:
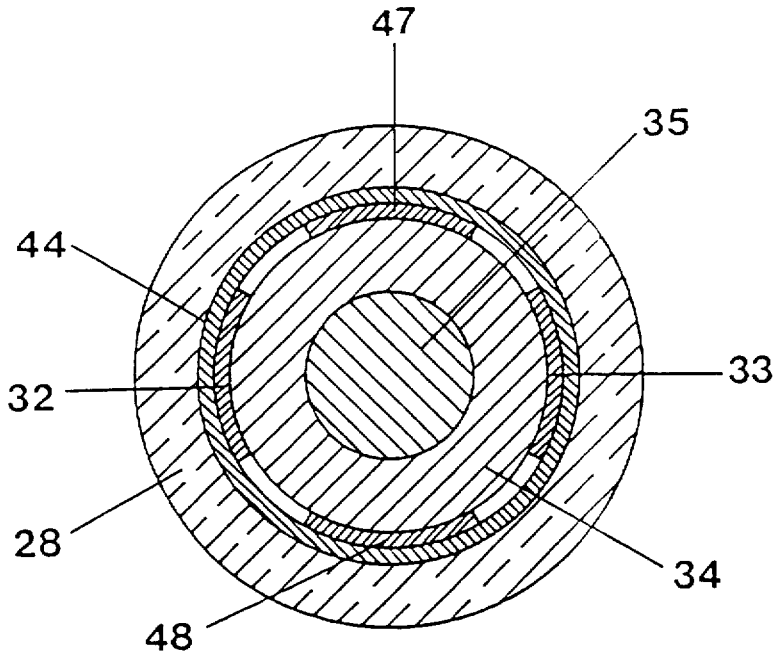
Figure 6:
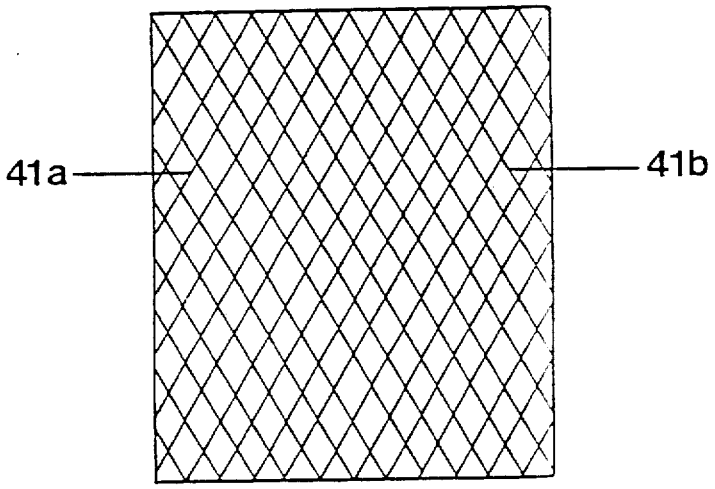

FIG. 4 is a longitudinal section through a neck tube of a further embodiment of a high-pressure discharge lamp in accordance with the invention;

FIG. 5 is a cross section through the neck tube of the high-pressure discharge lamp of FIG. 4 taken along the line V-V; and FIG. 6 is a highly schematic top view of a profiled or embossed foil.

DETAILED DESCRIPTION

Figure 1:
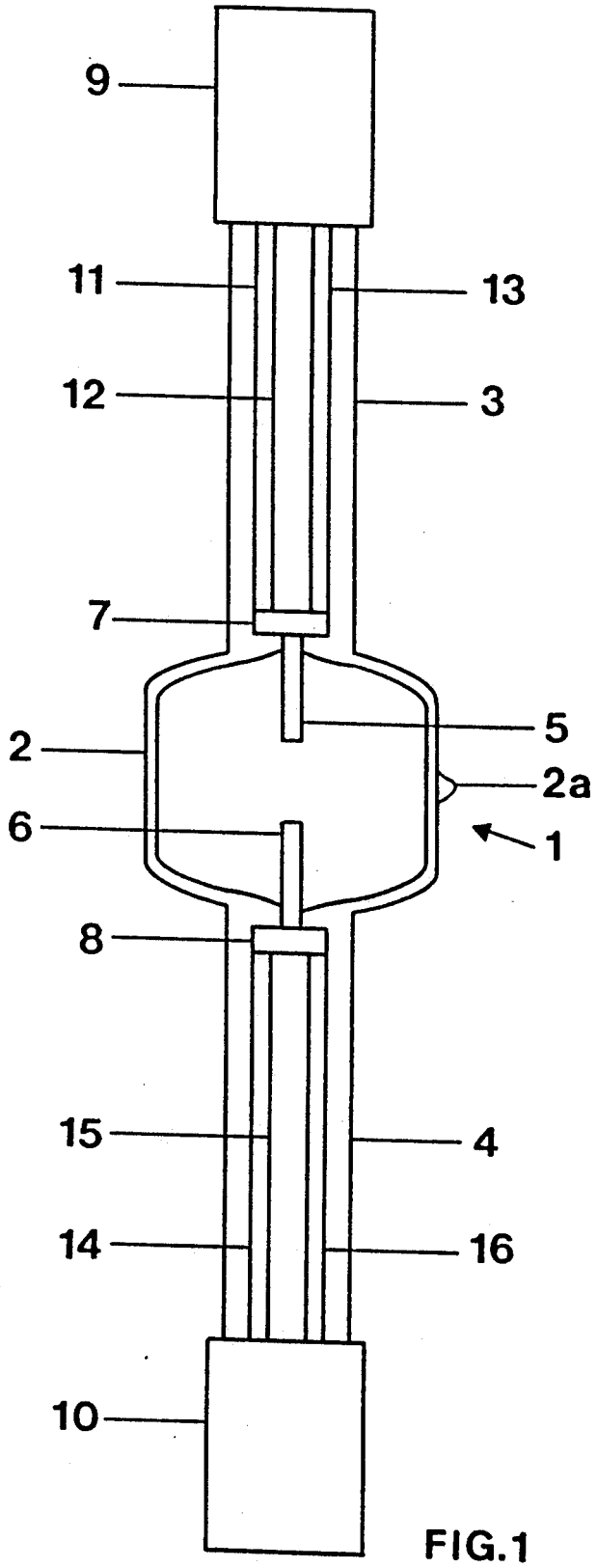
FIG. 1 is a side view of the high-pressure discharge lamp in accordance with the invention, omitting features not material for an understanding thereof.

The lamp 1 of FIG. 1, for purposes of illustration, is a high-power high-pressure discharge lamp having a power rating of 24,000 W. The lamp bulb 1 has an essentially cylindrical, rotation-symmetrical discharge vessel or discharge space 2, to which, in axial alignment, hollow cylindrical necks 3, 4 are melt-connected. The discharge vessel 2, when finished, will have a small gas connection nipple 2*a* formed thereon which, in the finished lamp, is tipped off.

The discharge within the discharge vessel 2 extends between the end portions of two rod or pin electrodes 5, 6 made of tungsten.

In accordance with a feature of the invention, the tungsten electrodes 5, 6 are each fitted through a central hole in a circular cylindrical disk 7, 8 of molybdenum, and secured to the respective disk by a platinum solder or brazing connection. The electrical connection of the pin electrodes 5, 6 with bases 9, 10, in accordance with a feature of the invention, is effected by four ribbon or tape-like molybdenum sealing foils, of which in FIG. 1 only three foils 11, 12, 13 for the upper electrode, and 14, 15, 16 for the lower electrode are visible. The bases 9, 10 may be, for example, of the type S30×70 of IEC Standard 61, slipped over the end portions of the necks 3, 4. The sealing foils 11 to 16, in accordance with a further feature of the invention, are welded with their ends to the respective disks 7, 8, through which the ends of the shafts of the electrodes 5, 6 have been fitted. The other ends of the sealing foils 11–16 are similarly connected with a second disk, not visible in FIG. 1, since hidden behind the respective bases 9, 10. These disks, that is, disks 7 and 8 as well as the disks at the other ends of the sealing foils 11–16, are made of molybdenum. All the disks are circular cylindrical elements, formed with a central hole through which, respectively, the electrodes 5, 6 or externally extending current supply leads 23 (FIG. 2), are passed, each secured by platinum solder or brazing.

The projecting end of the current supply lead, each, is electrically connected to the respective base 9, 10. The sealing foils 11–16 are melt-sealed and melted together with the necks 3, 4, extending parallel to the longitudinal axis of the lamp, and are gas-tightly secured in the necks.

The specific connection, and the sequence of manufacturing steps, is best seen when considering FIGS. 2 and 3.

The respective neck 3, 4 is formed as a hollow, cylindrical outer tube 17 of quartz glass, which is melt-sealed to the discharge vessel 2, defining the discharge space. A filling body of quartz glass is fitted within the hollow cylindrical tube 17. The fill body of quartz glass is formed by a solid central quartz glass cylinder 18 and two short hollow cylindrical elements 19, 20 melted-on the end of the solid cylinder 18.

A further hollow cylindrical quartz glass tube 21 is fitted over the hollow cylindrical portions 19, 20 and the solid central core 18. All these cylinders are melted together, so that the hollow cylinder 21, together with the core 18, as well as with the cylindrical portions 19, 20, forms a solid quartz glass body.

A disk 8 of molybdenum, with the pin electrode 6, is placed on one end of the solid body 18–19, 20–21. The pin electrode 6, made of tungsten, passes through the molybdenum disk 8. Similarly, a disk 22, likewise of molybdenum, through which an external current supply lead 23 passes with the lead 23, is placed on the other end, in FIG. 2 the lower end, of the fill body 18–19, 20–21. The internal diameter of the short hollow cylindrical elements 19, 20 corresponds to the outer diameters of the ends of the electrode 6, and the current supply connection lead 23, respectively, fitted through suitable holes of the disks 8, 22. The internal diameters, respectively, of the hollow cylindrical elements 19, 20 may be slightly greater than the diameters of the projecting ends of the pin electrode 6 and of the current supply lead 23 in order to prevent cracking of the bulb neck as a result of the higher coefficient of expansion of the metal parts than that of glass. Four sealing foils of molybdenum, of which in FIG. 2 only the foils 14, 16 are visible, extend parallel to the axis of the neck portion between the outer tube 17 and the fill body. The ends of the foils are welded to the disks 8, 22.

After forming this initial subassembly, a hollow cylindrical quartz glass tube 24 is fitted over the current supply lead 23. The inner diameter of the quartz glass tube 24 corresponds to the outer diameter of the current supply lead 23. The quartz glass tube 24, at an end portion remote from the discharge vessel 2, is formed with an outwardly extending bulge 25, roughly in olive, ring, or barrel shape, extending up to the inner wall of the neck tube 17.

After introduction of the subassembly of the fill body with the metallic connection elements into the neck portion 17, disk 8 is fitted against a further hollow cylindrical plug element 26 of quartz glass, which is melt-sealed in the transition region between the discharge space 2 and the connecting neck, that is, is melt-sealed into the outer neck tube 17. After complete finishing of the lamp, it provides for the centering of the electrode and also thermally isolates the interior of the discharge vessel 2 from the melt-sealed connecting elements 8, 14 in the neck tube 17.

FIG. 3 illustrates the arrangement, looking in the direction of the arrows of the section line A-B, that is, towards the discharge space 2. FIG. 3 illustrates the outer hollow cylindrical neck tube 17, as well as the composite fill body, at the section location formed by the quartz tube 21 and the core 18. The end of the electrode shaft is visible through the transparent quartz glass. The four uniformly distributed molybdenum sealing foils 14, 15, 16, 27, uniformly distributed about the circumference of the disk 8, likewise are seen in FIG. 3.

The expanded portion 25 (FIG. 2) is melt-sealed to the outer tube 17 to provide a gas-tight connecting rim. This permits flushing the space between the hollow cylindrical outer tube 17 and the fill body with argon and the like, and subsequent evacuation, and, thereafter, at a vacuum of 20 mbar argon, melt-sealing the hollow cylindrical outer tube 17 to the fill body 18–19, 20–21, with the sealing foils surrounding the fill body. After melt-sealing the outer tube 17 to the fill body, the neck, as well as the quartz glass tube 24 are severed at a suitable level above the end portion of the external current supply lead 23 to permit making an electrical connection thereto, and fitting of the base 10 thereon. An end disk 17*a* can be placed on electrode 23, or the neck similarly deformed, see FIG. 2*a*.

The lamp discharge vessel then can be filled with the appropriate noble gas - mercury - metal halide fill and tipped off as schematically shown at 2*a* (FIG. 1).

The table 1, forming part of this specification, provides suitable data for a metal halide discharge lamp, as illustrated in FIG. 1.

TABLE 1

| | | |
|---|---|---|
| lamp power | 24000 | W |
| lamp voltage | 225 | V |
| lamp current | 125 | A |
| light flux | above 2000000 | lm |
| volume of discharge vessel 2 | 250 | $cm^3$ |
| length of arc | 45 | mm |
| color temperature | 6000 | K. |
| overall length of the lamp | max. 60 | cm |
| average lifetime | 200 | h |
| width of foils 11–16, 27: | 10 | mm |
| length of foils: | 15 | cm |
| thickness of foils: | 50 | μm |
| diameter of molybdenum disk 8, 22: | 1.6 | cm |
| thickness of disks 8, 22: | 5 | mm |
| axial length of quartz glass tube elements 19, 20: | 10 | mm |
| inner diameter of neck element 17: | 19 | mm |
| wall thickness of neck element 17: | 2.5 | mm |

FIG. 4 illustrates a bulb neck of an extra-high-pressure mercury vapor discharge lamp having a rated power of 2000 W. The bulb neck comprises a hollow cylindrical outer tube 28 of quartz glass with an electrode system gas-tightly sealed therein. The electrode system comprises an electrode head 29 of tungsten welded to the electrode shaft 30, also of tungsten. The free end of the electrode shaft 30 is fitted into a central hole in a circular cylindrical molybdenum disk 31 and is soldered or brazed thereto. The molybdenum disk has a thickness of 5 mm. The molybdenum disk 31 has the ends of four equidistantly spaced ribbon-like molybdenum sealing foils 32, 33, 47, 48 welded thereto along its circumference. Only the two foils 32, 33 are visible in FIG. 4. The other ends of the molybdenum sealing foils 32, 33 are welded to a second circular cylindrical molybdenum disk 34 which has a thickness of 5 mm and, likewise, a central hole. A current supply lead 35 of molybdenum is fitted into the central hole and is soldered or brazed thereto. The space between the two molybdenum disks 31, 34 is filled by two hollow cylinders 36, 37 of quartz glass which coaxially surround the end of the current supply lead 35 projecting beyond the molybdenum disk 34 in the direction of the discharge space. The outer hollow cylinder 37 is closed at the end facing the discharge space. The four sealing foils 32, 33 are gas-tightly melt-sealed between the surface of the outer hollow cylinder 37 and the outer tube 28.

In accordance with a feature of the invention, a thin, profiled, or embossed molybdenum foil 38 is located between the inner hollow cylinder 36 and the projecting end of the current supply lead 35. The profiled molybdenum foil 38 completely surrounds the outer surface of the current supply lead 35 in this region, for example, by being wrapped about the current supply lead 35 by 1 to 2 turns, preferably about 1.25 to 1.5 turns. The other end of the current supply lead 35 which is remote from the discharge space and the electrode shaft 30 is surrounded in the region of the bulb neck by further hollow cylinders 39, 40 of quartz glass which, during the melt-sealing step, are sealed to the outer tube 28. Direct contact of the electrode shaft 30 and of the current supply lead 35 with the hollow cylinders 39, 40 is prevented by two profiled foils 41, 42 which completely surround the outer surface of the electrode shaft 30 and of the current supply lead 35 in this region. In addition, the outer surfaces and the base surfaces of the molybdenum disks 31, 34 facing the hollow cylinders 39 and 40 are surronded by a thin, profiled molybdenum foil 43–46.

FIG. 5 illustrates a section through the bulb neck of FIG. 4 along the section line V—V in the direction of the discharge space. It shows the hollow cylindrical outer tube 28 which surrounds the profiled molybdenum foil 44, the four molybdenum sealing foils 32, 33, 47, 48, the molybdenum disk 34 and the current supply lead 35.

The following table 2, which forms part of the specification, provides suitable data for an extra-high pressure mercury vapor discharge lamp, as partly illustrated in FIGS. 4 and 5.

FIG. 6 shows embossing, or profiling ridges 41*a*, 41*b* which intersect each other at an angle of 60°. This angle is not critical. The ridges, of course, appear as grooves on the backside of the foil.

TABLE 2

| | |
|---|---|
| lamp power | 2000 W |
| lamp voltage | 37 V |
| lamp current | 54 A |
| volume of discharge vessel | 110 $cm^3$ |
| length of arc | 3 mm |
| overall length of the lamp | 29 cm |
| average lifetime | 750 h |
| width of foils 32, 33, 47, 48 | 8 mm |
| length of foils | 5 cm |
| thickness of foils | 50 μm |
| diameter of molybdenum disk 31, 34 | 1.5 cm |
| thickness of disks 31, 34 | 5 mm |
| axial length of quartz glass tube elements 36 | 3.5 cm |
| inner diameter of neck element 28 | 19 mm |
| wall thickness of neck element 28 | 2.5 mm |
| base thickness, before embossing of foils 38, 41–46 | 22 μm |
| overall thickness after embossing | 26 μm |

Various changes and modifications may be made within the scope of the inventive concept.

We claim:

1. A double-ended, high-pressure discharge lamp, capable of carrying lamp currents above 20 A, having a discharge vessel (2) of quartz glass defining a generally rotation-symmetrical discharge space therein;

two lamp necks (3,4) extending coaxially from opposite axial ends of the rotation-symmetrical discharge vessel (2) and melt-sealed to the discharge vessel;

two electrodes (5, 6, 29) each having an electrode shaft (30) located partly within the discharge space and having a shaft portion extending into the respective neck (3, 4);

two external current supply leads (23, 35) each extending into the respective neck (3, 4) and electrically connected to a respective base (9, 10); and a fill, including a noble gas, and optionally mercury, and a metal halide within the discharge space, said lamp comprising a high current carrying sealing and electrical connection arrangement between each of the electrodes (5, 6, 29) and the current supply leads (23, 35) including a first metal disk (7, 8; 31) electrically and mechanically secured to an end region of the respective electrode (5, 6, 29);

a second metal disk (22, 34) electrically and mechanically secured to an end region of the respective current supply lead (23, 35);

at least two elongated sealing foils (11–16, 27; 32, 33, 47, 48) extending between said first and second disks and within the respective neck, spaced from each other;

a quartz glass filling within said respective necks, embedding said at least two sealing foils, said first and second disks and ends of the electrode shafts (30) and of the current supply leads (23, 35), being melt-sealed to the respective neck, said necks, together with the quartz glass filling, forming solid quartz glass cylinders in which said sealing foils are melt-sealed; and means for thermally isolating the interior of the discharge vessel from the sealing and electrical connection arrangement, and for centering the electrode shaft (30) of the respective electrode, including a plug element (26, 40) formed with an aperture, fitted and melt-sealed into a respective transition region of the neck adjacent the discharge vessel, the respective electrode shaft passing through the aperture of the plug element, said plug element, in operation of the lamp, separating the first metal disk (7, 8; 31) from the fill in the discharge vessel.

2. The lamp of claim 1, wherein four elongated sealing foils (11–16, 27; 32, 33, 47, 48) are provided, extending between said first and second disks (7, 8; 22; 31, 34).

3. The lamp of claim 1, wherein said sealing foils (11–16, 27; 32, 33, 47, 48) are elongated ribbons or tapes or strips.

4. The lamp of claim 1, wherein said disks (7, 8; 22; 31, 34) located in said necks (3, 4) are circular-cylindrical and have a diameter of between 2 and 20 mm.

5. The lamp of claim 1, wherein said sealing foils (11–16, 27; 32, 33, 47, 48) are uniformly distributed about the circumference of said disks (7, 8; 22, 31, 34), and extend parallel to the longitudinal axis of the respective neck (3, 4).

6. The lamp of claim 1, wherein the ends of the electrode shafts (30) and of the current supply leads (35) as well as the metal disks (31, 34) sealed into the bulb necks have wrapped partly or completely thereabout a refractory metal foil (38, 41, 42, 43–46) provided with a surface profile or embossing.

7. The lamp of claim 6, wherein the metal foil (38, 41, 42, 43–46) provided with a surface profile is a metal or an alloy of a metal selected from the group consisting of molybdenum, tantalum or tungsten.

8. The lamp of claim 6, wherein the metal foil (38, 41, 42, 43–46) provided with a surface profile has a base thickness of between 0.02 mm and 0.2 mm.

* * * * *

UNITED STATES PATENT AND TRADEMARK OFFICE

CERTIFICATE OF CORRECTION

PATENT NO. : 5,304,892

DATED : April 19, 1994

INVENTOR(S) : LEWANDOWSKI, ET AL

It is certified that error appears in the above-indentified patent and that said Letters Patent is hereby corrected as shown below:

Delete drawing figure 4, 5,and 6, and substitute therefor the drawing sheets, consisting of Figure 4-6, as shown on the attached pages.

Signed and Sealed this

Eighteenth Day of July, 1995

Bruce Lehman

*Attest:*

BRUCE LEHMAN

*Attesting Officer*

*Commissioner of Patents and Trademarks*